US008931726B2

(12) United States Patent
Omae

(10) Patent No.: US 8,931,726 B2
(45) Date of Patent: Jan. 13, 2015

(54) WIRE WINDING-OFF AUXILIARY DEVICE

(75) Inventor: Yuuki Omae, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 429 days.

(21) Appl. No.: 13/376,356

(22) PCT Filed: Jun. 2, 2010

(86) PCT No.: PCT/JP2010/059364

§ 371 (c)(1),
(2), (4) Date: Jan. 11, 2012

(87) PCT Pub. No.: WO2010/140626

PCT Pub. Date: Dec. 9, 2010

(65) Prior Publication Data

US 2012/0111991 A1 May 10, 2012

(30) Foreign Application Priority Data

Jun. 3, 2009 (JP) ..... 2009-134423

(51) Int. Cl.
*B65H 57/18* (2006.01)
*B21C 47/16* (2006.01)
*B21C 47/34* (2006.01)

(52) U.S. Cl.
CPC ..... *B21C 47/16* (2013.01); *B21C 47/34* (2013.01)
USPC ..... 242/566; 242/615.2; 242/128; 226/189

(58) Field of Classification Search
USPC ..... 242/128, 566, 615.2; 226/189, 181, 226/193; 140/147
See application file for complete search history.

(56) References Cited

U.S. PATENT DOCUMENTS 2,453,337 A 11/1948 Enez
2,511,274 A * 6/1950 Kramer ..... 140/1
2,693,219 A * 11/1954 Heller ..... 72/162
3,107,701 A * 10/1963 Hoad ..... 140/147
3,269,672 A * 8/1966 Steinback ..... 242/128

(Continued)

FOREIGN PATENT DOCUMENTS

JP S59-34807 U 3/1984
JP 04-125010 U 11/1992

(Continued)

OTHER PUBLICATIONS

Chinese Office Action and search report, dated Sep. 9, 2013, issued in corresponding Chinese Patent Application No. 201080024302.2.

(Continued)

*Primary Examiner* — William E Dondero
(74) *Attorney, Agent, or Firm* — Sughrue Mion, PLLC

(57) ABSTRACT

To provide a wire unwinding auxiliary device capable of, compared to a conventional device, effectively preventing an unwound wire material from getting twisted, entangled or flawed.

A wire unwinding auxiliary device used for guiding an unwound wire material when unwinding the wire material which is wound in a coiled shape. The device comprises a plurality of rotation members 1*a*-1*e* on which the unwound wire material is set to run therethrough, and a non-rotation member 2 provided adjacent to at least a rotation member 1*a* through which the wire material passes first in the plurality of rotation members 1*a*-1*e*, thereby a running path of the wire material is stabilized between the non-rotation member 2 and the rotation member 1*a*.

6 Claims, 1 Drawing Sheet

(56) References Cited

U.S. PATENT DOCUMENTS

| | | | | |
|---|---|---|---|---|
| 3,282,304 | A * | 11/1966 | Coleman | 242/566 |
| 4,148,448 | A | 4/1979 | Weber | |

FOREIGN PATENT DOCUMENTS

| | | | |
|---|---|---|---|
| JP | 5-138350 | A | 6/1993 |
| JP | 5-253617 | A | 10/1993 |
| JP | 6-79348 | A | 3/1994 |
| JP | 7-076743 | A | 3/1995 |
| JP | 7-232213 | A | 9/1995 |
| JP | 2000-349120 | A | 12/2000 |
| JP | 3269022 | B2 | 3/2002 |
| JP | 2007-238323 | A | 9/2007 |

OTHER PUBLICATIONS

International Search Report of PCT/JP2010/059364 dated Jul. 27, 2010.

Extended European Search Report dated Nov. 18, 2014, issued in corresponding European Patent Application No. 10783408.7.

* cited by examiner

WIRE WINDING-OFF AUXILIARY DEVICE

TECHNICAL FIELD

The present invention relates to wire unwinding auxiliary devices (hereinafter, referred to also as "unwinding auxiliary device"), more particularly to a wire unwinding auxiliary device which is used for various application on a wire processing machine or the like for unwinding a wire material wound in a coiled shape.

BACKGROUND ART

When a wire material wound in a coiled shape is unwound to process the same, as an intermediate quality of the wire material, it is essential that the unwound wire material have no twist or entanglement and the unwound wire material be prevented from getting flawed. If the wire material has any twist, entanglement or flaw, winding failure, breaking of wire or the like may be frequently caused therefrom resulting in an interruption of mass production of processed wire.

As a technique to prevent such twist and/or entanglement of wire material, conventionally there is known an unwinding auxiliary device which comprises a plurality of straightening rotation members on which unwound wire material is set to run therethrough, and a wire material feeder guide for guiding the wire material to the straightening rotation members. The conventional unwinding auxiliary device is able to prevent the wire material from getting twisted or entangled by feeding the wire material to the straightening rotation members through the wire material feeder guide and causing the wire material to run through the plurality of straightening rotation members.

Also, for example, Patent Literature 1 teaches a wire material take-out and guiding device which includes a wire material guide having a corn-like shape, the diameter of which gets larger downward, and a wire material guide roller provided to a support post, in which a guide ring having a conical shape the diameter of which gets larger upward is provided to the top of an upright wire material carrier; and the wire material is guided through the guide ring, the corn-like wire material guide and the guide roller on the support post in order.

RELATED ART DOCUMENTS

Patent Document

Patent Document 1: Japanese Unexamined Patent Application Publication No. 5-253617 (paragraph [0004] and the like)

SUMMARY OF INVENTION

Technical Problem

However, in the conventional wire unwinding auxiliary device, the unwound wire material is sufficiently prevented from getting twisted or entangled, and in a point of view of flaw prevention on the wire material also, further improvement is required.

Accordingly, an object of the invention is to provide a wire unwinding auxiliary device which is, compared to the conventional device, capable of preventing the unwound wire material from getting twisted, entangled or flawed more effectively.

Solution to Problem

As a result of intensive study, the inventor found that, to prevent the unwound wire material from getting twisted, entangled and/or flawed as an intermediate quality of the wire material, it is critical to optimize the incoming angle of the wire material with respect to the rotation member. That is, if the incoming angle of the wire material is not proper with respect to the rotation member, the wire material may get not only twisted but also entangled easily, and in a worst case, the entanglement may cause a break of the wire material. Therefore, it is essential that not only the incoming angle of the wire material should be optimized but also the wire material should be stabilized so that the incoming angle does not deviate from the proper angle.

From this point of view, as a result of further study, the inventor found the following fact; i.e. when a non-rotation member is provided adjacent to a rotation members on which the unwound wire material is set to run therethrough, the running path of the wire material is stabilized between the non-rotation member and the rotation members; and compared to the conventional device, the wire material can be prevented more effectively from getting twisted, entangled or flawed. Thus, the invention has been achieved.

That is, a wire unwinding auxiliary device according to the invention is a wire unwinding auxiliary device used for guiding an unwound wire material when unwinding the wire material wound in a coiled shape, comprising:

a plurality of rotation members on which the unwound wire material is set to run therethrough; and a non-rotation member provided adjacent to at least a rotation member through which the wire material passes first in the plurality of rotation members, wherein a running path of the wire material is stabilized between the non-rotation member and the rotation member.

The unwinding auxiliary device according to the invention preferably comprises a guide portion having an open port for guiding the wire material between the rotation member and the non-rotation member; and further preferably comprises a ring member having a conical shape, the diameter of which gradually getting larger from the guide portion toward the side where the wire material is unwound, the ring member being provided continuously to the guide portion.

The rotation member is preferably made of a material with HRA of 80 or more and 95 or less. The degree of surface roughness of a portion of the rotation members where comes into contact with the wire material is preferably Ra 2.0 or less.

Advantageous Effects of Invention

According to the invention, by adopting the above-described constitution, it is made possible to achieve a wire unwinding auxiliary device with which, compared to the conventional device, not only the wire material can be prevented from getting twisted or entangled but also the wire material can be effectively prevented from getting flawed. With the unwinding auxiliary device according to the invention, since the wire material can be prevented from getting twisted or entangled during unwinding, the wire material can be stably supplied. Moreover, as an additional effect, such effect is also obtained that coating film adhered to the surface of the wire material product can be effectively removed before the wire material is subjected to the processing.

BRIEF DESCRIPTION OF DRAWINGS

FIG. 1 (*b*) is an elevation view thereof.

DESCRIPTION OF EMBODIMENTS

Embodiments of the invention will be described in detail below with reference to the drawings.

Figure 1A:
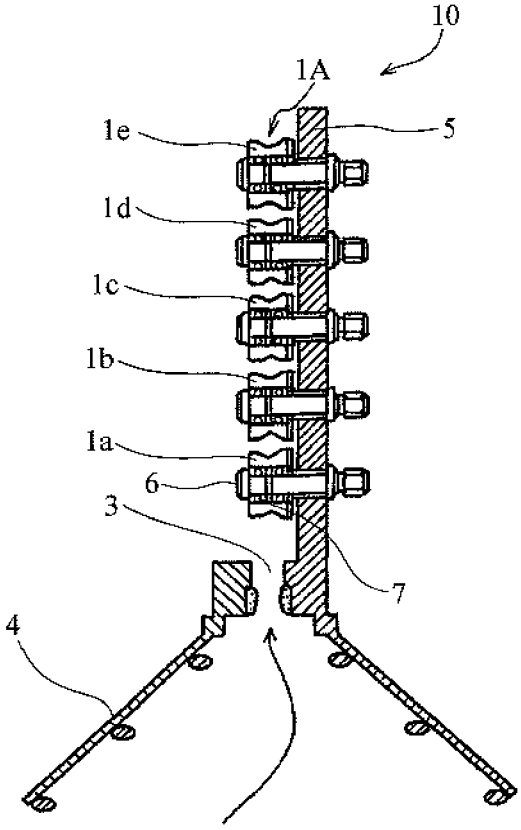
FIG. 1 (*a*) is a cross-sectional view showing a wire unwinding auxiliary device according to an embodiment of the invention.
Figure 1B:
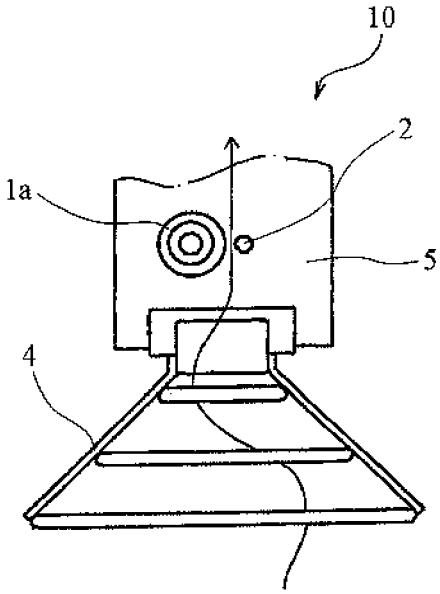

FIG. 1 (*a*) is a cross-sectional view and FIG. 1 (*b*) is an elevation view showing an example of a wire unwinding auxiliary device according to the invention. The wire unwinding auxiliary device according to the invention is used for guiding a wire material to unwind a wire material which is wound in a coiled shape. The wire material is fed upward from the bottom side as indicated with arrows in the figures.

As shown in the figures, the unwinding auxiliary device 10 according to the invention comprises a plurality of rotation members 1*a*-1*e* on which the unwound wire material is set to run therethrough, and a non-rotation member 2 provided adjacent to the rotation member 1*a*, thereby the running path of the wire material between the non-rotation member 2 and the rotation member 1*a* is stabilized By disposing the non-rotation member adjacent to the rotation member to stabilize the running path of the wire material, the incoming angle of the wire material is constantly stabilized optimally, twist, entanglement and/or flaw generated on the wire material can be largely reduced.

As shown in the figures, each of the rotation members 1*a*-1*e* on the unwinding auxiliary device 10 according to the invention has a groove portion 1A for maintaining the wire material in a central area as viewed in a width direction thereof in order to allow the wire material to run thereon. Each of the rotation members 1*a*-1*e* is fixed to plate base 5 via a shaft 6 and a bearing 7 so as to rotate on the shaft 6. According to the invention, the fixing method and number of the rotation members are not particularly prescribed, but they may be appropriately determined according to the unwinding conditions of the wire material. Typically 3-7 rotation members are disposed in a zigzag manner on the base 5.

To optimize the incoming angle of the wire material, the non-rotation member 2 according to the invention should be provided adjacent to at least the rotation member 1*a* on which the wire material passes first in the plurality of the rotation members 1*a*-1*e*. Here, the wording "adjacent to the rotation member" means that the non-rotation member is disposed with a distance between the rotation member and the non-rotation member so that the running path of the wire material is stabilized. However, the distance between the rotation member and the non-rotation member is not particularly prescribed.

As shown in the figures, the unwinding auxiliary device according to the invention, in addition to the non-rotation member 2, a guide portion 3 having an open port for guiding the wire material is preferably provided between the rotation member 1*a* and the non-rotation member 2. By providing the guide portion 3, the wire material can be prevented from getting twisted or entangled more effectively.

Here, a ring member 4 is more preferably provided continuously to the guide portion 3. The ring member 4 has a conical shape, the diameter of which gets gradually larger from the guide portion 3 toward the side where the wire material is unwound (lower side in the figures) as shown in the figures. By providing the ring member 4, the wire material comes into contact with the ring member 4 and the wire material is uncurled. By causing the wire material to enter into the guide portion 3 in an uncurled state, the wire material can be prevented more effectively from getting entangled.

According to the invention, the rotation member is preferably made of a material with HRA (Rockwell hardness A scale) 80 or more and 95 or less. By making the rotation member using a material of high mechanical strength which fulfils the requirement of HRA of 80 or more and 95 or less, the wire material can be prevented more effectively from getting flawed. Also, such a problem that the service life of the rotation member is remarkably short can also be eliminated. The mechanical strength of the rotation members is more preferably HRA 85 or more and 95 or less. Depending on the mechanical strength of the wire material to be unwound, the mechanical strength of the rotation members is preferably as high as possible.

Moreover, according to the invention, degree of surface roughness of the portion of the rotation members where comes into contact with the wire material preferably has arithmetic average Ra 2.0 or less. As to at least the portion where comes into contact with the wire material, by using a rotation member having a low degree of surface roughness, i.e. having an extremely smooth surface, the wire material can be more effectively prevented from getting flawed. The degree of surface roughness of the rotation member is more preferably 1.0 or less, particularly, 0.1-0.3; with a value as small as possible.

Furthermore, in point of view of stable unwinding of the wire material, the configuration of the rotation member is: depth of the groove portion 1A is preferably 10-20 mm; and the curvature radius R of the bottom of the groove portion 1A is preferably 5 mm or less.

As to the material for the rotation members used in the invention, in point of view of the strength and the degree of surface roughness are satisfied, for example, cemented carbide or the like may be preferably used. Also, as to the non-rotation member, when the unwound wire material is stably held between the rotation member and the non-rotation member, the material, shape and fixing method thereof to the base are not particularly prescribed.

Since the unwinding auxiliary device 10 according to the invention has the above-described constitution, not only the wire material is prevented from getting twisted, entangled or flawed but also such function that coating film adhered to the surface of the wire material product can be removed is obtained. The unwinding auxiliary device 10 according to the invention is applicable to various types of wire material of steel wire material, copper wire material or the like.

EXAMPLES

The invention will be described more particularly below.

Example 1

The wire unwinding auxiliary device 10 shown in FIG. 1 was used, and an unwound wire material which was wound in a coiled shape was unwound and guided therethrough. As to 5 rotation members 1*a*-1*e* were made of a material of cemented carbide with HRA 88; with Ra 0.2 degree of roughness on the surface of a portion where comes in contact with the wire material; and the depth of the groove portion 1A was 10 mm. Also, only one non-rotation member 2 was provided adjacent to the rotation member 1*a*. A hard steel wire was used as the wire material.

Example 2

Using an unwinding auxiliary device same as the Example 1 excepting a point that the ring member 4 was not provided, unwound wire material was guided.

Example 3

Using an unwinding auxiliary device same as the Example 1 excepting a point that the guide portion 3 and the ring member 4 were not provided, unwound wire material was guided.

Comparative Example

Using an unwinding auxiliary device same as the Example 1 excepting a point that the non-rotation member 2, the guide portion 3 and the ring member 4 were not provided, an unwound wire material was guided.

After wire material was unwound by 5350 m, twist, entanglement and flaw generated on the wire material were counted as an index of unwinding failure. As a result, it was verified that, compared to the unwinding auxiliary device of the Comparative example which has no non-rotation member, in the unwinding auxiliary devices of the Examples 1-3 which were provided with the rotation members and the non-rotation member, number of unwinding failures caused from twist, entanglement and flaw on the wire material was largely reduced.

Also, comparing the unwinding auxiliary devices of the Examples 1-3, in the Example 1 in which, in addition to the rotation member and the non-rotation member, the guide portion and the ring member were provided, number of unwinding failures was smallest; while the in Example 3 in which only the rotation member and the non-rotation member were provided, number of unwinding failures were largest. Therefore, it was verified that, in addition to the rotation members and the non-rotation member, by providing the guide portion, a larger reduction efficiency of unwinding failure can be obtained; and by providing the ring member, a further large reduction efficiency of unwinding failure can be obtained.

REFERENCE SIGNS LIST

1*a*-1*e*: rotation member
1A: groove portion
2: non-rotation member
3: guide portion
4: ring member
5: base
6: shaft
7: bearing
10: unwinding auxiliary device

The invention claimed is:

1. A wire unwinding auxiliary device used for guiding an unwound wire material when unwinding a wire material wound in a coiled shape, comprising:

a plurality of rotation members on which the unwound wire material is configured to run therethrough;

a non-rotation member provided adjacent to a first rotation member of the plurality of rotation members, the first rotation member provided at an upstream position from remaining rotation members of the plurality of rotation members in a wire material pass direction; and a gap provided between the first rotation member and the non-rotation member, the unwound wire material running through the gap, wherein the gap is configured to stabilize a running path of the unwound wire material, and wherein an axis of the non-rotation member extends substantially parallel with a rotational axis of the first rotation member.

2. The wire unwinding auxiliary device according to claim 1, further comprising a guide portion having an open port configured to guide the unwound wire material between the first rotation member and the non-rotation member.

3. The wire unwinding auxiliary device according to claim 2, further comprising a ring member having a conical shape, the diameter of which gradually getting larger from the guide portion toward the side where the wire material is unwound, the ring member being provided continuously to the guide portion.

4. The wire unwinding auxiliary device according to claim 1, wherein the plurality of rotation members are made of a material with HRA of 80 or more and 95 or less.

5. The wire unwinding auxiliary device according to claim 1, wherein a degree of surface roughness of a portion of each of the plurality of rotation members configured to contact with the wire material is Ra 2.0 or less.

6. The wire unwinding auxiliary device according to claim 1, wherein the non-rotation member is disposed orthogonally with respect to the wire material pass direction from the first rotation member.

* * * * *